US005752865A

United States Patent [19]

Ishii et al.

[11] Patent Number: 5,752,865

[45] Date of Patent: May 19, 1998

[54] SHIP

[75] Inventors: Norio Ishii; Kazuo Arai; Hiroshi Tomaru; Akihiko Fujii; Yuki Takahashi, all of Tokyo, Japan

[73] Assignee: Mitsui Engineering & Shipbuilding Co., Ltd., Tokyo, Japan

[21] Appl. No.: 737,603

[22] PCT Filed: Apr. 19, 1995

[86] PCT No.: PCT/JP95/00772

§ 371 Date: Nov. 25, 1996

§ 102(e) Date: Nov. 25, 1996

[87] PCT Pub. No.: WO96/32318

PCT Pub. Date: Oct. 17, 1996

[30] Foreign Application Priority Data

Apr. 11, 1995 [JP] Japan ..... 7-085756

[51] Int. Cl.[6] ..... B63H 1/16

[52] U.S. Cl. ..... 440/67; 416/189

[58] Field of Search ..... 440/66, 67; 416/189

[56] References Cited

FOREIGN PATENT DOCUMENTS

| | | |
|---|---|---|
| 56-147196 | 11/1981 | Japan . |
| 57-109098 | 7/1982 | Japan . |
| 58-143793 | 9/1983 | Japan . |
| 2 073 689 | 10/1981 | United Kingdom . |

*Primary Examiner*—Jesus D. Sotelo

*Attorney, Agent, or Firm*—Nikaido, Marmelstein, Murray & Oram LLP

[57] ABSTRACT

A circular nozzle disposed in front of a propeller of a ship has a leading edge thereof which divided an upper leading edge and a lower leading edge. The upper leading edge approaches progressively the propeller disc toward the lower part thereof, the angle of inclination of the upper leading edge and that of the lower leading edge become different, with the junction part at which the upper and lower leading edges meet being the border, and the junction is positioned in the proximity of a horizontal plane including the axis line of the propeller shaft.

3 Claims, 7 Drawing Sheets

SHIP

Technical Field

This invention relates to a ship equipped with a circular nozzle in front of a propeller of the ship to improve the propulsion performance of the ship.

BACKGROUND ART

Circular nozzles respectively mounted in front of the ship's propeller include a wedge-shaped one 3a as shown in FIG. 9 and a trapezoidal one (not shown) when they are viewed from a side.

The nozzle, particularly the one shown in FIG. 9, can reduce the development of three-dimensional separated vortices broken out from bilges on both sides of a hull to concentratedly settle the flow portion having a large wake coefficient w (w=(Vs−Va)/Vs) flowing into the region in the proximity of the upper part of the propeller disc area.

The nozzle can decrease the hull resistance and can improve the propulsion efficiency η ($\eta=\eta_h\cdot\eta_o\cdot\eta_R$). Here, $V_s$ is the speed of the ship, and Va is a propeller inlet velocity $\eta_h$ is called a hull efficiency, and is given by $$\eta_h=(1-t)/(1-w)$$

$\eta_o$ is the open propeller efficiency in the state that the influence of the hull does not exist. $\eta_R$ is called a relative rotative efficiency, and is the ratio of the propeller efficiency to the open propeller efficiency $\eta_o$ in the state the propeller operates in the wake near the stern. Further, the symbol t is the thrust deduction fraction.

In order to allow the nozzle to display its performance described above, a circulation Γ acting on the nozzle is increased. As shown in FIG. 10, to increase this nozzle circulation Γ, the angle of attach α of the flow flowing into the nozzle 3a is increased and the chord length L of the nozzle 3a is increased, too.

In the recent full-bodied ships, however, the wake has a flow distribution on the propeller disc area as shown in FIG. 11, and the in-plane flow in the propeller plane has a direction shown in FIG. 12.

In the case of a wedge-shaped nozzle 3a shown in FIG. 9, therefore, the flow has a distribution having an angle of attack α and a velocity Va at the nozzle leading edge LE (refer to FIG. 10), as shown in FIG. 13. The abscissa of FIG. 13 represents the angle in the nozzle circumferential direction, when the angle is measured clockwise when the nozzle is viewed from the bow from the position of 0 o'clock when the nozzle is looked on as a clock. It can be seen from FIG. 13 that the field of flow is symmetric with respect to the line representing 180°.

The propulsion force $F_N$ acting on the nozzle is the sine component of the angle β of the lift $L_N$ acting on the nozzle as shown in FIG. 10 and is expressed as $$F_N=L_N \sin\beta$$

On the other hand, the lift $L_N$ is proportional to the circulation Γ of the nozzle, and the circulation Γ is proportional to the angle of attack α and the chord length L of the nozzle.

$$L_N\propto\Gamma\propto\alpha\cdot Va^2\cdot L$$

Therefore, the propulsion force $F_N$ acting on the nozzle is:

$$F_N\propto\alpha\cdot Va^2\cdot L\cdot \sin\beta$$

A frictional resistance Df also acts on the nozzle section. This frictional resistance Df is written as $$Df\propto Va^2L$$

The force $F_T$ acting on the nozzle is given by $$F_T=(C_1\cdot\alpha\cdot \sin\beta-C_2)Va^2\cdot L\equiv A\cdot Va^2\cdot L$$

In the above equation, $C_1$ and $C_2$ are proportional constants.

In order to improve the propulsion efficiency η, therefore, it is understood that the chord length L of the nozzle must be increased at the part at which the angle of attack α is great and A is positive, and must be decreased at the part at which the angle of attack α is small and A is negative.

FIG. 14 shows the distribution of the force $F_T$ acting on the wedge-shaped nozzle shown in FIG. 9. When the diameter of the aft end of the nozzle becomes smaller than the diameter of the propeller, however, the distribution of the angle of attack α and the flow velocity Va at the fore end of the nozzle becomes the ones shown in FIG. 15, and the force $F_T$ acting on the nozzle becomes the one shown in FIG. 16.

As shown in FIGS. 14 and 16, the nozzle becomes a resistance near 90° and 270° measured from the nozzle apex 0° in the clockwise direction, and the abilities of the nozzle cannot be fulfilled to the maximum in the case of the wedge-shaped nozzle and the trapezoidal nozzle shown in FIG. 8.

DISCLOSURE OF THE INVENTION

The object of the present invention is to provide a ship equipped with a circular nozzle solving the problems described above.

In other words, the present invention is characterized in that in a ship equipped with a circular nozzle disposed in front of a propeller of the ship, the leading edge of the nozzle divided an upper leading edge and a lower leading edge, the upper leading edge approaches progressively the propeller toward the lower part thereof, the angle of inclination of the upper leading edge and that of the lower leading edge is different, with the junction part at which the upper and lower leading edges meet being the border, and the junction is positioned in the proximity of the horizontal plane including the axis line of the propeller shaft.

Desirably, the diameter $D_N$ of the trailing of the nozzle is from 40 to 110% of the diameter $D_P$ of the propeller.

If the diameter $D_N$ of the aft end part of the nozzle is less than 40% of the diameter $D_P$ of the propeller, the flow velocity Va becomes small over the entire circumference, and the propulsion force $F_N$ acting on the nozzle becomes small. When the diameter $D_N$ of the nozzle aft end part exceeds 110% of the propeller diameter $D_P$, on the contrary, the flow velocity Va shown in FIG. 13 becomes great over the entire circumference, but the angle of attack α becomes small as a whole, so that the propulsion force $F_N$ becomes small whereas the frictional resistance becomes great.

Further, it is desirable that the nozzle is fixed to the hull through upper and lower, two support members, and twist is presented to each support members in the direction opposite to the rotating direction of the propeller.

As described above, in the circular nozzle disposed in front of the propeller of the ship, the leading edge of the nozzle divided the upper leading edge and the lower leading edge, the upper leading edge progressively approaches the propeller toward the lower part thereof, the angle of inclination of the upper leading edge and that of the lower leading edge become different, with the junction part at which the upper and lower leading edges meet being the border, and the junction is positioned in the proximity of the horizontal plane including the axis line of the propeller shaft. According to this construction, though the component of the propulsion force of the nozzle does not much change, the components acting as the resistance drastically decrease.

As the resistance component of the nozzle decrease, the rate of flow flowing into the nozzle becomes great, too. Eventually, therefore, the flow having a large wake coefficient w can be settled more concentratedly, so that the nozzle effect can be shown to the maximum and propulsion efficiency I can be improved more greatly.

BEST MODE CARRYING OUT THE INVENTION

Hereinafter, embodiments of the present invention will be explained with reference to the drawings.

Figure 1:
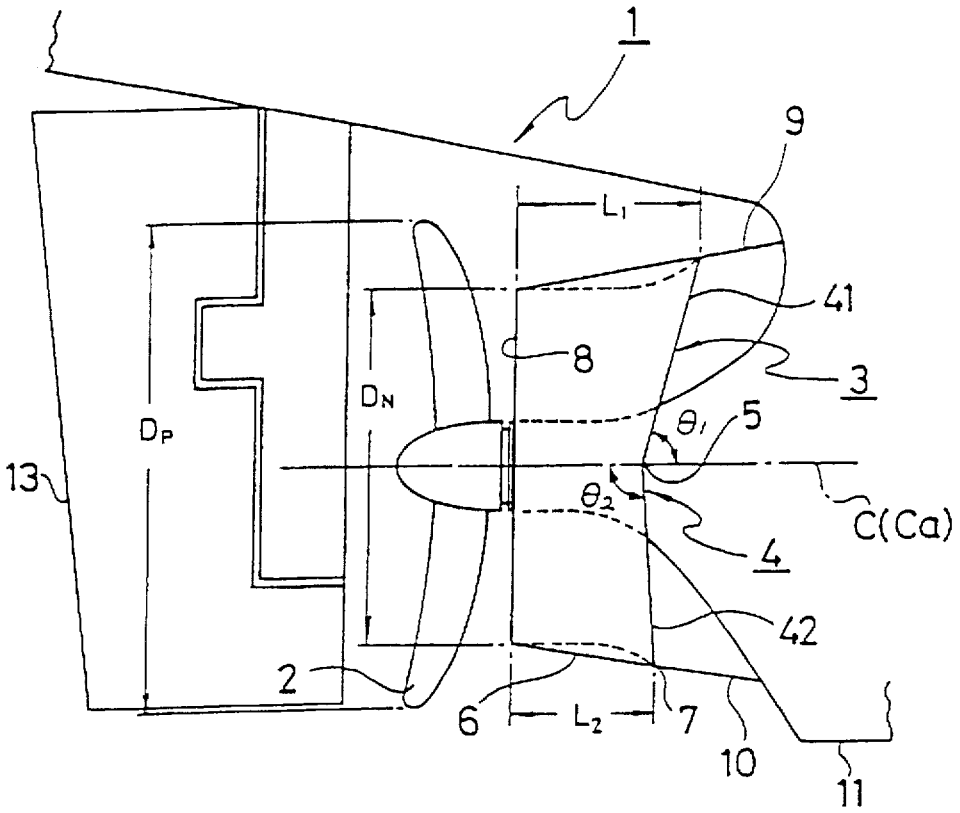
FIG. 1 is a side view of a ship according to the present invention.

Referring to FIG. 1, reference numeral 1 denotes a ship, which is equipped with a circular nozzle 3 in front of a propeller 2. The diameter of the nozzle 3 decreases toward the aft end. The axis line Ca of this nozzle 3 is coaxial with the axis line C of the propeller shaft, and the nozzle 3 has an aerofoil section which camber protrudes inward in the plane including the axis line C of the propeller shaft.

The nozzle 3 has a leading edge 4 divided into an upper leading edge 41 and a lower leading edge 42, and the upper leading edge 41 progressively approaches the propeller 2 toward the lower part thereof. The junction part D at which the upper leading edge 41 meets the lower leading edge 42 is closer to the propeller 2 than the pointed end 7 of the nozzle bottom part 6.

This junction part 5 is also a point of inflection at which the angle of inclination $\theta_1$ of the upper leading edge 41 of the nozzle changes to the angle of inclination $\theta_2$ of the lower leading edge 42. Here, $\theta_2>\theta_1$.

Further, the junction part 5 described above is positioned on the horizontal plane including the axis line C of the propeller shaft. The lower part of the trailing edge 8 of the nozzle 3 is progressively closer to the than the upper bow toward part thereof.

Figure 2:
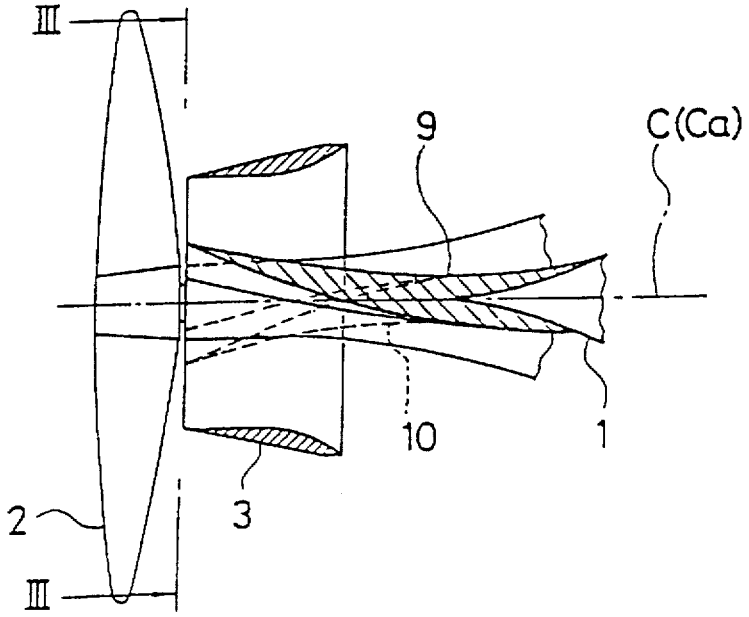
FIG. 2 is a sectional view of an essential portion of a ship according to the present invention.
Figure 3:
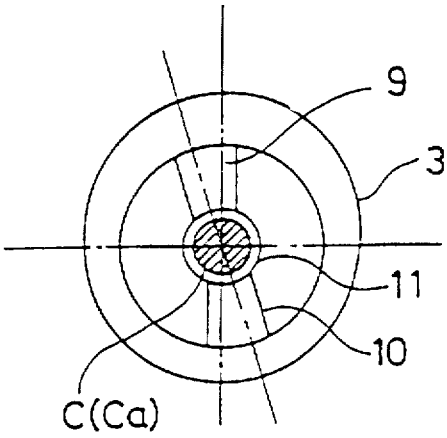
FIG. 3 is a sectional view taken along a line III—III of FIG. 2.

The nozzle 3 is fixed to the hull 11 through upper and lower two support members 9 and 10. The thickness of each of these support members 9 and 10 decreases progressively toward the rear part thereof as shown in FIG. 2 and moreover, has a twist in the direction opposite to the rotating direction of the propeller 2. This arrangement can reduce the swirl in the same direction as the propeller rotating direction behind the propeller 2.

Figure 7:
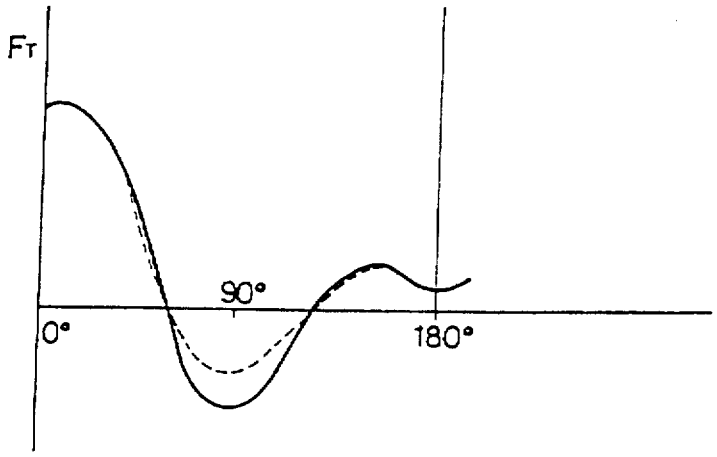
FIG. 7 is a distribution diagram of a force Ft acting on a nozzle.

When the circular nozzle 3 described above is used, the force Ft acting on the nozzle has a distribution shown by the dash line in FIG. 7. Incidentally, the solid line shows the distribution of the force Ft acting on the wedge-shaped nozzle.

As can be appreciated from FIG. 7, the propulsion force component of the nozzle does not much change, but the component serving as the resistance decreases greatly. When the resistance component of the nozzle decreases, the rate of flow entering the nozzle becomes great, too. Eventually, therefore, the flow having a large wake coefficient w can be settled more concentratedly, so that the nozzle effect can be exhibited to the maximum and the propulsion efficiency $\eta$ can be improved more greatly.

Figure 8:
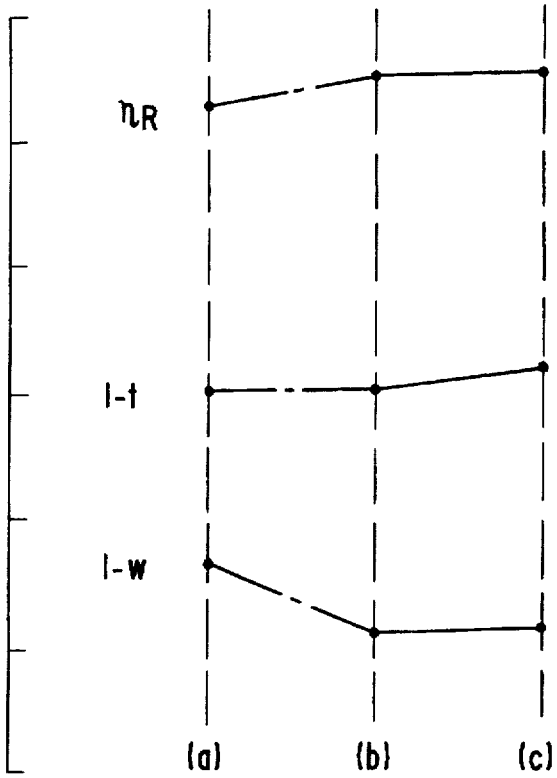
FIG. 8 is an explanatory view showing the difference of self-propulsion factors, wherein (a) shows the case that a nozzle is not provided, (b) shows the case that a wedge-shaped nozzle is used (refer to FIG. 9) and (c) represents the case of the present invention.
Figure 9:
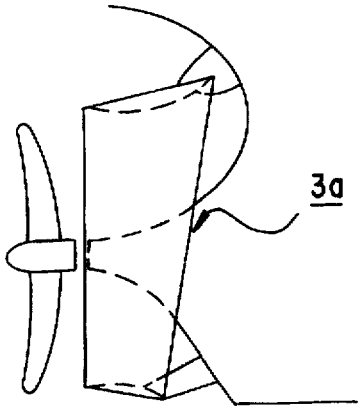
FIG.9 PRIOR ART
FIG. 9 is a side view of a conventional ship having a wedge-shaped nozzle.
Figure 10:
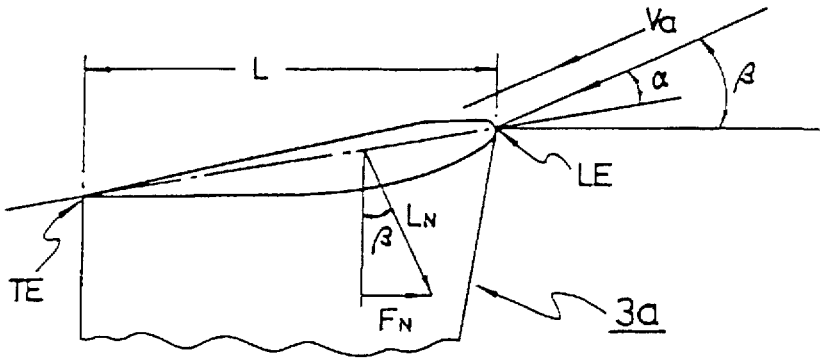
FIG. 10 is an explanatory view of the functions of a nozzle.
Figure 11:
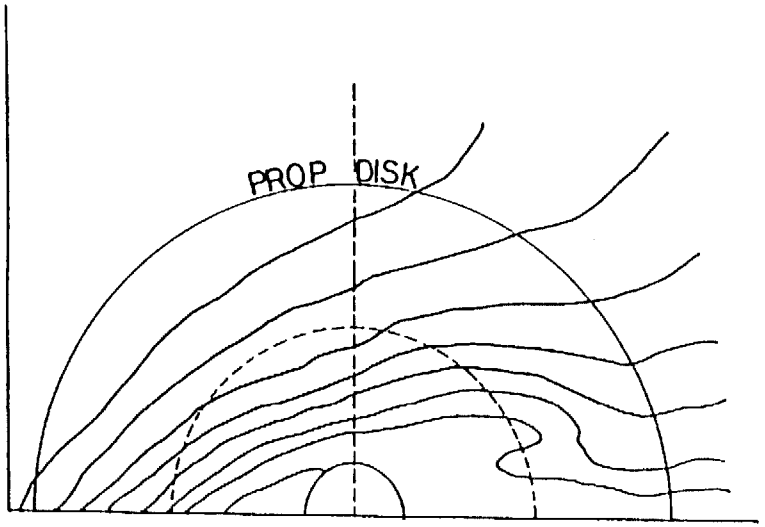
FIG. 11 is a diagram showing the wake distribution in the propeller disc plane.
Figure 12:
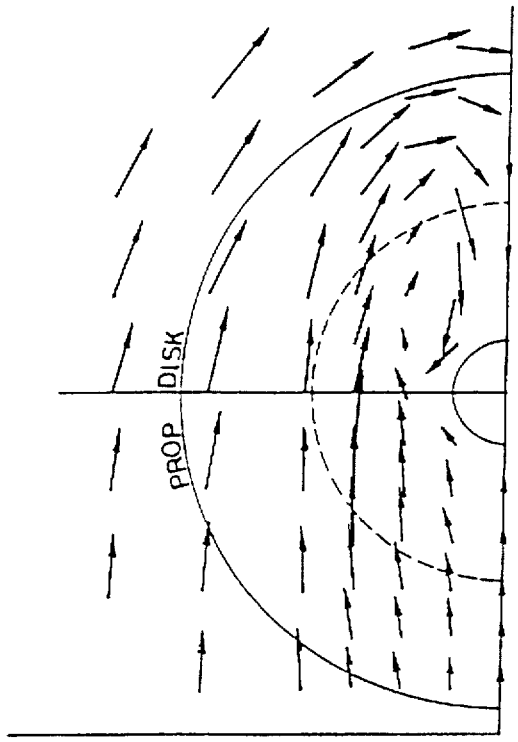
FIG. 12 is a vector diagram of the in-plane direction of the flow in the propeller disc plane.
Figure 13:
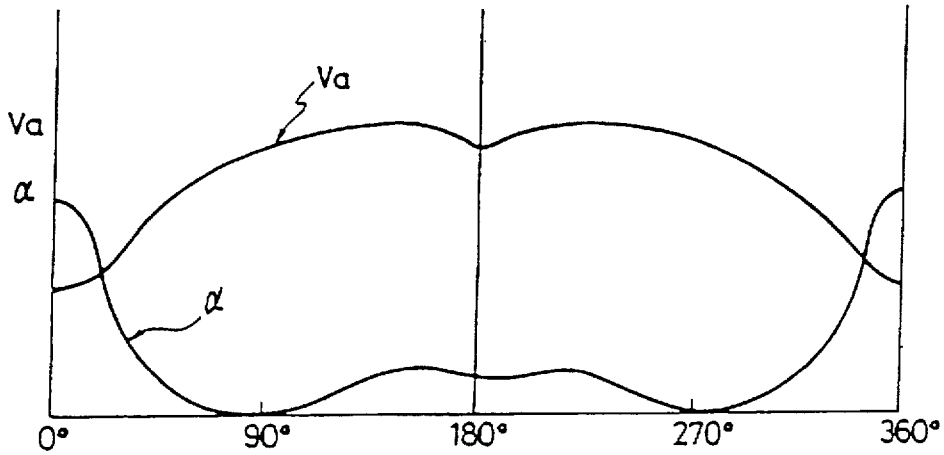
FIG. 13 is a diagram showing the distribution of the angle $\alpha$ of attack and the flow velocity Va in a nozzle circumferential direction.
Figure 14:
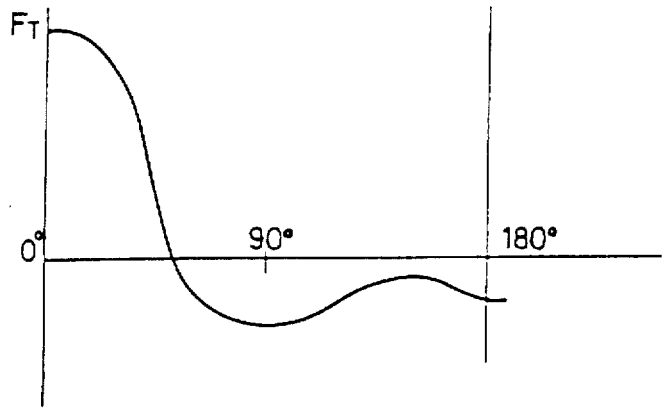
FIG. 14 is a diagram of showing the distribution of the force Ft acting on the nozzle.
Figure 15:
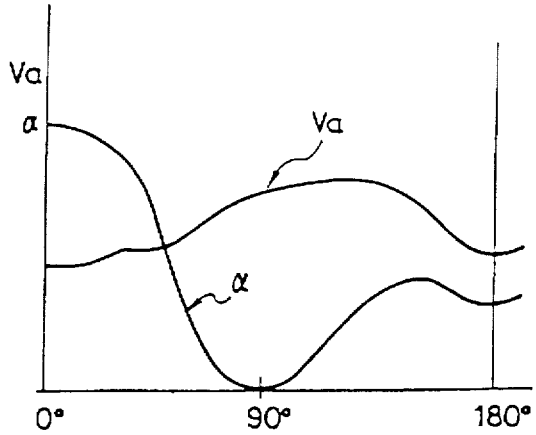
FIG. 15 is a diagram showing the distribution of the angle $\alpha$ of attack and the flow velocity Va in a nozzle circumferential direction when the nozzle diameter is smaller than the propeller diameter.
Figure 16:
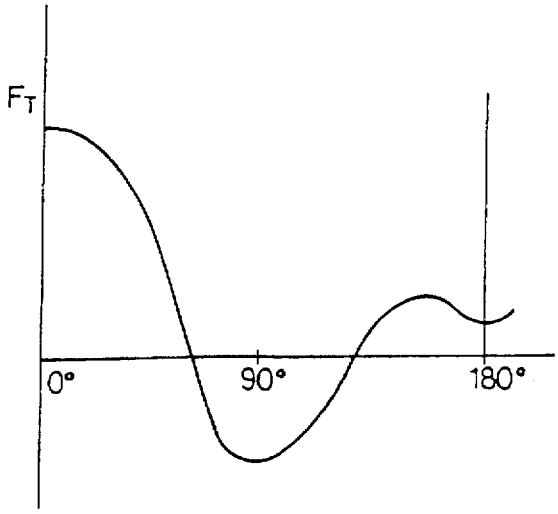
FIG. 16 is a diagram showing the distribution of the force Ft acting on the nozzle when the nozzle diameter is smaller than the propeller diameter.

FIG. 8 shows how the self-propulsion factors ($\eta_R$, 1−t, 1−w) relating to the propulsion efficiency $\eta$ can be improved. It can be appreciated from FIG. 8 that 1−t increases and the nozzle operation becomes more effective in the present invention. Incidentally, (a) in FIG. 8 shows the case where no nozzle is provided, (b) shows the case where the wedge-shaped nozzle shown in FIG. 9 is used, and (c) shows the case of the present invention.

This tendency can be similarly expected not only when the diameter $D_N$ at the nozzle aft part is smaller than the diameter $D_P$ of the propeller but also when it is greater than the propeller diameter $D_P$. It is desirable that the diameter $D_N$ of the nozzle rear end part is about from 40 to 110% of the propeller diameter $D_P$. Incidentally, reference numeral 13 of FIG. 1 denotes a rudder.

Figure 4:
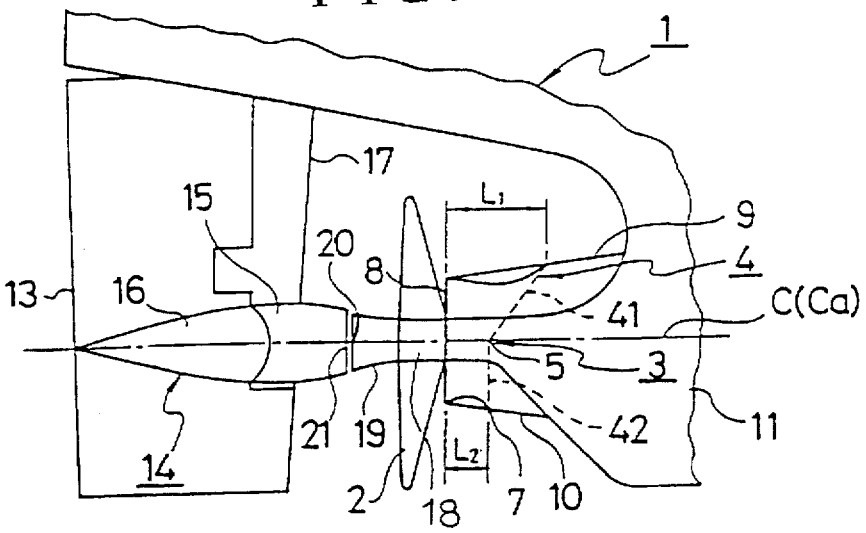
FIG. 4 is a side view of a ship of another embodiment according to the present invention.

When a costa bulb 14 is fitted to the rudder 13 as shown in FIG. 4, the hull resistance can be further decreased due to the synergistic effect with the nozzle 3.

This costa bulb 14 comprises a head part 15 and a body part 16. The head part 15 is fixed to a rudder horn 17, and the body part 16 is fixed to the rudder 13. The rear end part of a cap 19 and the rear end surface 21 of the head part 15 have an almost equal diameter so that no step exists between the cap 19 fitted to a propeller boss 18 and the costa bulb 14, and the flow becomes more smooth.

Figure 5:
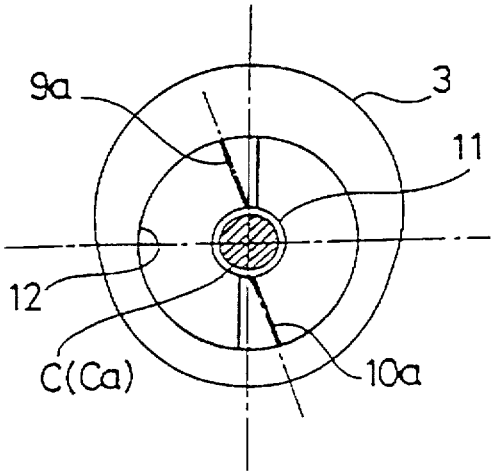
FIG. 5 is a rear view of a ring, showing another example of a support member for supporting a nozzle.
Figure 6:
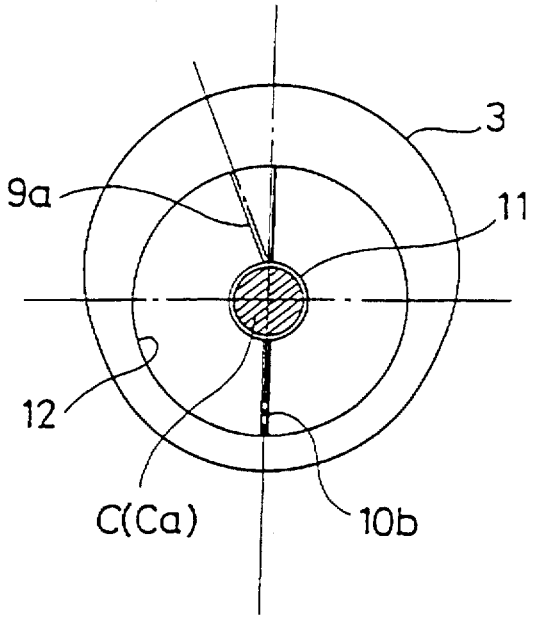
FIG. 6 is a rear view of a ring, showing an example where twist is imparted to only an upper support member.

The degree of twist of the support members 9*a* and 10*a* may be increased progressively as the distance to the inner wall surface 12 of the nozzle 3 becomes shorter as shown in FIG. 5. Further, it is also possible to employ the construction wherein the twist is imparted to only the upper support member 9*a* and the lower support member 10*b* has a straight structure extending along the axis line C of the propeller shaft as shown in FIG. 6.

When the nozzle 3 is viewed from the beside, its junction 5 is positioned on the axis line C of the propeller shaft, however, the similar effect can be produced even when the junction 5 is positioned somewhat above the axis line C of the propeller shaft or somewhat below the axis line C.

The trailing edge 8 and the lower leading edge 42 of the nozzle 3 may be vertical. The nozzle chord length at the junction 5 may be so set minimum according to the field of the flow.

In FIG. 1, symbol $L_1$ represents the chord length at the nozzle top end, and $L_2$ does the chord length at the nozzle bottom end.

In a ship equipped a circular nozzle in front of the propeller, the present invention employs the construction wherein the leading edge of the nozzle is divided into the upper leading edge and the lower leading edge, the upper leading edge progressively approaches the propeller toward the lower part thereof, the angle of inclination of the upper leading edge of the nozzle and the angle of inclination of its lower leading edge are different, with the junction part at which the upper leading edge and the lower leading edge meet being the border, and the junction part is positioned in the proximity of the horizontal plane inclusive of the axis line of the propeller shaft. Therefore, the resistance component drastically decreases, though the propulsion component of the nozzle does not much change, and the flowing rate into the nozzle becomes great, too.

Because of the concentrated settling of the flow having a large wake coefficient w, the effect of the nozzle can be improved to the maximum and the propulsion efficiency $\eta$ can be greatly improved.

What is claimed is:

1. A ship comprising; a hull, a propeller shaft extending out of said hull and having an axis, a propeller mounted on said shaft, and a circular nozzle set in front of said propeller, said nozzle having a leading edge, said leading edge being divided into an upper leading edge and a lower leading edge and having a point of junction where said upper leading edge and said lower leading edge meet, said point of junction being located in the proximity of a horizontal plane containing said axis of said propeller shaft, said upper leading edge progressively approaching said propeller toward the lower part thereof, an angle of inclination of said upper leading edge and an angle of inclination of said lower leading edge becoming different at said point of junction, said nozzle being fixed to the hull through two support members, said support members including an upper support member and a lower support member, said two support members being imparted with a twist in the direction opposite to the normal, forward rotating direction of said propeller.

2. A ship comprising: a hull, a propeller shaft extending out of said hull and having an axis, a propeller mounted on said shaft, and a circular nozzle set in front of said propeller, said nozzle having a leading edge, said leading edge being divided into an upper leading edge and a lower leading edge and having a point of junction where said upper leading edge and said lower leading edge meet, said point of junction being located in the proximity of a horizontal plane containing said axis of said propeller shaft, said upper leading edge progressively approaching said propeller toward the lower part thereof, an angle of inclination of said upper leading edge and an angle of inclination of said lower leading edge becoming different at said point of junction, said nozzle being fixed to the hull through two support members, said support members including an upper support member and a lower support member, said upper support member being imparted with a twist in the direction opposite to the normal, forward rotating direction of said propeller.

3. A ship according to either of claims 1 or 2, wherein the diameter $D_N$ of said nozzle at the rear end part thereof is from 40 to 110% of the diameter DP of said propeller.

* * * * *